US011987465B2

(12) United States Patent
Gillier et al.

(10) Patent No.: US 11,987,465 B2
(45) Date of Patent: May 21, 2024

(54) ADAPTIVE PRESSURE MEDIA FEEDING

(71) Applicant: NCR Corporation, Atlanta, GA (US)

(72) Inventors: Jason Michael Gillier, Waterloo (CA); Matthew Sonnenberg, Kitchener (CA); Benjamin T. Widsten, Kitchener (CA)

(73) Assignee: NCR Corporation, Atlanta, GA (US)

( * ) Notice: Subject to any disclaimer, the term of this patent is extended or adjusted under 35 U.S.C. 154(b) by 360 days.

(21) Appl. No.: 16/672,583

(22) Filed: Nov. 4, 2019

(65) Prior Publication Data

US 2020/0062522 A1 Feb. 27, 2020

Related U.S. Application Data

(62) Division of application No. 15/222,252, filed on Jul. 28, 2016, now Pat. No. 10,472,191.

(51) Int. Cl.

| | |
|---|---|
| ***B65H 1/14*** | (2006.01) |
| ***B65H 1/04*** | (2006.01) |
| ***B65H 1/24*** | (2006.01) |
| ***B65H 3/04*** | (2006.01) |
| ***B65H 3/54*** | (2006.01) |
| ***B65H 7/02*** | (2006.01) |
| ***B65H 7/06*** | (2006.01) |
| ***B65H 7/18*** | (2006.01) |

(52) U.S. Cl.

CPC ..... *B65H 3/54* (2013.01); *B65H 1/04* (2013.01); *B65H 1/14* (2013.01); *B65H 1/24* (2013.01); *B65H 3/047* (2013.01); *B65H 7/02* (2013.01); *B65H 7/18* (2013.01); *B65H 2515/34* (2013.01); *B65H 2701/1912* (2013.01)

(58) Field of Classification Search

CPC . B65H 1/14; B65H 1/18; B65H 1/025; B65H 1/24; B65H 7/02; B65H 7/18; B65H 2515/34; B65H 2701/1912; B65H 3/047; B65H 3/54; B65H 2511/524; B65H 7/06

See application file for complete search history.

(56) References Cited

U.S. PATENT DOCUMENTS

| | | | | |
|---|---|---|---|---|
| 4,561,644 | A | 12/1985 | Clausing | |
| 4,919,412 | A | 4/1990 | Weigel | |
| 4,925,177 | A | 5/1990 | Nakamura | |
| 5,163,666 | A * | 11/1992 | Kuo | G03G 15/60 271/34 |
| 5,927,703 | A | 7/1999 | Endo | |
| 6,293,539 | B1 * | 9/2001 | Fukatsu | B65H 1/14 271/154 |
| 7,396,010 | B2 * | 7/2008 | Naruoka | B65H 3/0653 271/149 |
| 7,753,360 | B2 * | 7/2010 | Takeuchi | B65H 1/14 271/111 |

(Continued)

FOREIGN PATENT DOCUMENTS

| | | | |
|---|---|---|---|
| JP | 04280743 | A | 10/1992 |
| JP | 04317933 | A * | 11/1992 |

(Continued)

*Primary Examiner* — Luis A Gonzalez

(74) *Attorney, Agent, or Firm* — Schwegman Lundberg & Woessner, P.A.

(57) ABSTRACT

A tiltenator of a media separator module (integrated within a valuable media depository) adaptively controls pressure maintained against a bunch of media as individual items from the bunch are fed through the media separator module.

3 Claims, 8 Drawing Sheets

(56) References Cited

U.S. PATENT DOCUMENTS

| | | | | |
|---|---|---|---|---|
| 8,002,262 | B2 | 8/2011 | Kelty | |
| 8,573,585 | B1 | 11/2013 | Boucher | |
| 8,746,673 | B1 | 6/2014 | Nickerson | |
| 2011/0101600 | A1 | 5/2011 | Chihara | |
| 2012/0061205 | A1* | 3/2012 | DaCunha | B65H 3/042 198/464.3 |
| 2013/0221606 | A1* | 8/2013 | Lai | B65H 3/0676 271/34 |
| 2015/0034457 | A1 | 2/2015 | Dunn | |
| 2016/0035171 | A1* | 2/2016 | Quijano | G07D 11/22 194/343 |

FOREIGN PATENT DOCUMENTS

| | | | | |
|---|---|---|---|---|
| JP | 04333432 | A | | 11/1992 |
| JP | 04341433 | A | * | 11/1992 |
| JP | 05032354 | A | | 2/1993 |

* cited by examiner

ADAPTIVE PRESSURE MEDIA FEEDING

BACKGROUND

Media handing devices that process media bunches must separate the items of media for individual processing downstream within the media handling devices. A media separator is a component of the media handling devices.

A front end component to the media separator is adapted to apply pressure to a bunch of media being fed into the media separator. Depending on a type of media (paper, cotton, polymer notes, cash, checks, etc.) and the condition of the media (new, worn, folded, crumpled, etc.) being inserted into the separator, the friction between the items of media in the bunch can vary greatly. Similarly, if the items of media are folded, curled, sprayed, skewed, etc., the feeding pressure may not be ideal for the separator. For example, if brand new checks are inserted, the inter-item friction in the bunch is much higher than between worn paper/cotton currency notes.

When the feed pressure for the bunch being fed into the media separator is too high, the items being separated from the bunch can separate too slowly or not at all due to excessive friction between the items in the bunch. This creates an increase in inter-item friction, which leads to aggressive feeding that can cause skewing, crumpling, and item damage; thus, increasing the likelihood of critical/fatal fault within the separator.

Similarly, if the feeding pressure is too low, the documents can separate too slowly or not at all due to belt slippage on the items being separated from the bunch of media and thereby causing faults.

Inconvenient faults occur when the items in the bunch do not separate within a set time period. A fatal fault occurs when the inconvenient fault cannot be ejected back out of the media separator due to excessive damage or jamming of an item within the separator.

SUMMARY

In various embodiments, methods and a system for adaptive pressure media feeding and processing within a valuable media depository are provided.

According to an embodiment, a method for adaptive pressure media feeding and processing is presented. Specifically, and in one embodiment, a pressure is set against a bunch of media items being fed individually from the bunch through a media separator module. Next, the pressure is adaptively adjusted for separating the items from the bunch and feeding the items through the media separator module.

DETAILED DESCRIPTION

Figure 1A:
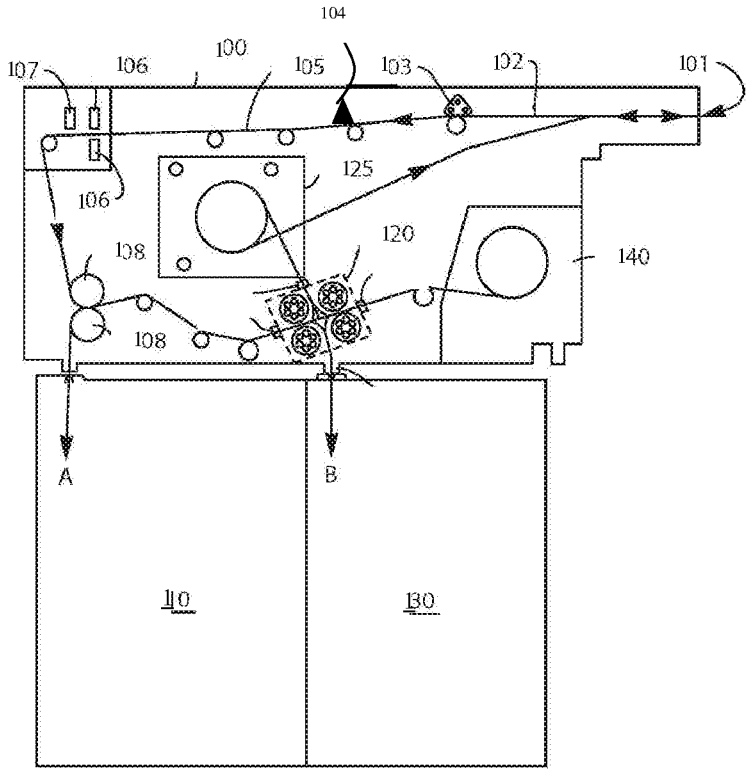
FIG. 1A is a diagram depicting a deposit module of a Self-Service Terminal (SST) having a media separator module, according to an example embodiment.

FIG. 1A is a diagram depicting a one-sided view of a valuable media depository 100, according to an example embodiment (also referred to as a deposit module). It is to be noted that the valuable media depository is shown with only those components relevant to understanding what has been added and modified to a conventional depository for purposes of providing adaptive pressure media feeding and processing within the depository 100.

The depository 100 is suitable for use within an Automated Teller Machine (ATM), which can be utilized to process deposited banknotes and checks (valuable media as a mixed bunch if desired). The deposit module 100 has an access mouth 101 (media or document infeed) through which incoming checks and/or banknotes are deposited or outgoing checks and/or banknotes are dispensed. This mouth 101 is aligned with an infeed aperture in the fascia of the ATM in which the depository 100 is located, which thus provides an input/output slot to the customer. A bunch (stack) of one or more items (valuable media) is input or output. Incoming checks and/or banknotes follow a first transport path 102 away from the mouth 101 in a substantially horizontal direction from right to left shown in the FIG. 1A. They then pass through a novel separator module 103 (discussed in detail below with reference to the FIGS. 1B-1I, 2, and 3) and from the separator 103 to a deskew module 104 along another pathway portion 105, which is also substantially horizontal and right to left. The items are now de-skewed and aligned for reading by imaging cameras 106 and a Magnetic Ink Character Recognition (MICR) reader 107.

Items are then directed substantially vertically downwards to a point between two nip rollers 108. These nip rollers cooperate and are rotated in opposite directions with respect to each other to either draw deposited checks and/or banknotes inwards (and urge those checks and/or banknotes towards the right hand side in the FIG. 1A), or during another mode of operation, the rollers can be rotated in an opposite fashion to direct processed checks and/or banknotes downwards in the direction shown by arrow A in the FIG. 1A into a check or banknote bin 110. Incoming checks and/or banknotes, which are moved by the nip rollers 108 towards the right, enter a diverter mechanism 120. The diverter mechanism 120 can either divert the incoming checks and/or banknotes upwards (in the FIG. 1A) into a re-buncher unit 125, or downwards in the direction of arrow B in the FIG. 1A into a cash bin 130, or to the right hand side shown in the FIG. 1A into an escrow 140. Items of media from the escrow 140 can selectively be removed from the drum and re-processed after temporary storage. This results in items of media moving from the escrow 140 towards the left hand side of the FIG. 1A where again they will enter the diverter mechanism 120. The diverter mechanism 120 can be utilized to allow the transported checks (a type of valuable media/document) and/or banknotes (another type of valuable media/document) to move substantially unimpeded towards the left hand side and thus the nip rollers 108 or upwards towards the re-buncher 125. Currency notes from the escrow can be directed to the re-buncher 125 or downwards into the banknote bin 130.

As used herein, the phrase "valuable media" refers to media of value, such as currency, coupons, checks, negotiable instruments, value tickets, and the like.

For purposes of the discussions that follow with respect to the FIGS. 1A-1I, "valuable media" is referred to as currency and the "valuable media depository" is referred to as a "depository." Additionally, valuable media may be referred to as a "document" herein.

Figure 1B:
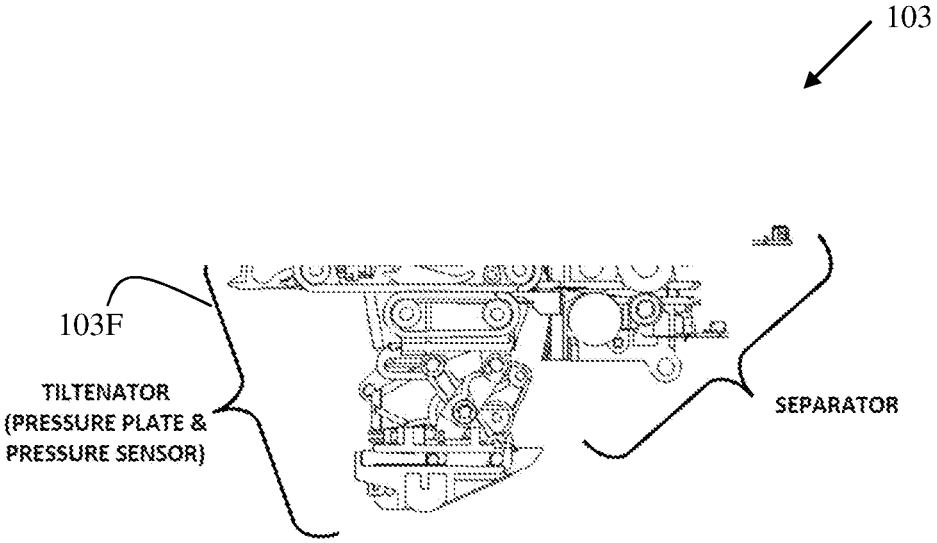
FIG. 1B is a diagram depicting a media separator module having a tiltenator, according to an example embodiment.

FIG. 1B is a diagram depicting a media separator module 103 having a tiltenator 103F, according to an example embodiment.

Only those components of the media separator module 103 that are necessary for understanding the teachings presented herein are labeled in the FIGS. 1B-1I that follow.

Visible in the top-to-bottom perspective of the media separator module 103 in the FIG. 1B is a top (from the perspective of the document's travel through the media separator module 103) or a first ultrasonic sensor 103A.

Figure 1C:
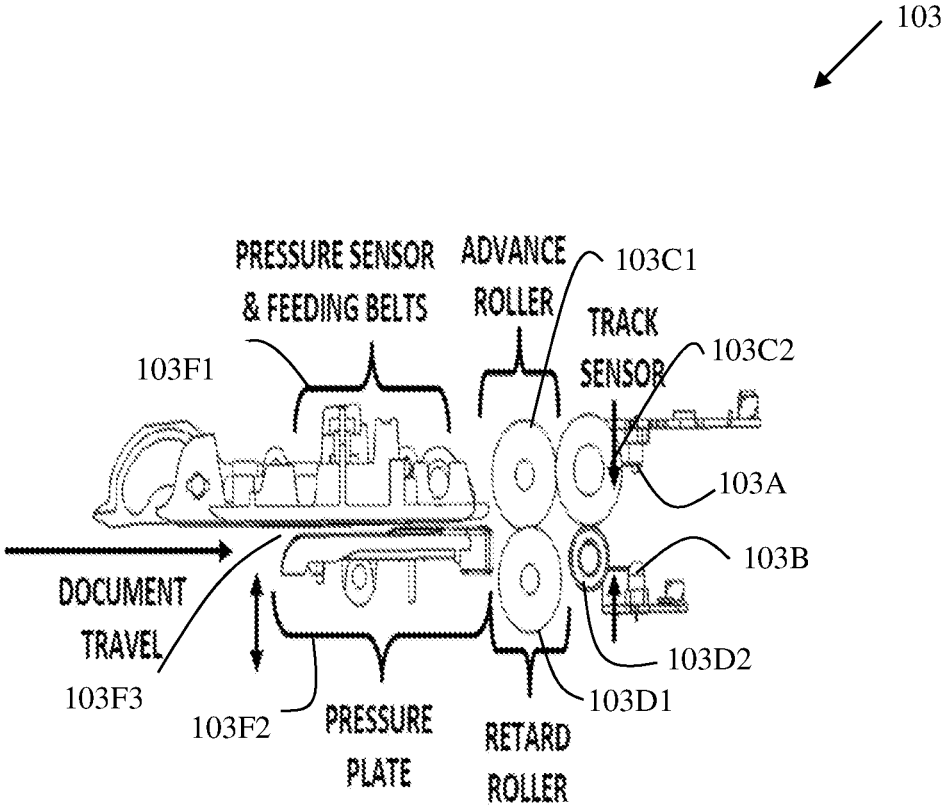
FIG. 1C is a diagram depicting a cross-section perspective of a media separator module having a tiltenator, according to an example embodiment.

FIG. 1C is a diagram depicting a cross-section perspective of a media separator module 103 having a tiltenator 103F, according to an example embodiment.

Visible in the cross-section perspective of the media separator module 103 in the FIG. 1C is: i) the first (top) ultrasonic sensor 103A which opposes a second (bottom) ultrasonic sensor 103B (the document passes through and between the first (top) ultrasonic sensor 103A and the second (bottom) ultrasonic sensor 103B, and ii) transport drives including a pair of adjacent upper (top) drives (rollers) 103C1 (advance roller) and 103C2 (exit rollers) which oppose a pair of adjacent lower (bottom) drives 103D1 and 103D2 (the document is urged along a path of travel between the two pairs of transport drives (103C1, 103C2, 103D1, and 103D2) and the ultrasonic sensors 103A and 103B.

The front-end of the media separator module 103 includes a novel tiltenator 103F. The tiltenator 103F includes a top portion including a variety of mechanical components including a pressure sensor and feeding belts 103F1; the bottom of the tiltenator 103F includes a variety of mechanical components including a pressure plate 103F. The tiltenator 103F is configured to receive a bunch of media items (documents) between the pressure sensor and feeding belts 103F1 and the pressure plate 103F2. A gap or space 103F3 grows or shrinks to accommodate a height of the bunch between 103F1 and 103F2. Pressure is applied to the bunch by the pressure plate 103F being driven upward against a bottom portion of the bunch and the corresponding pressure applied is measured by the pressure sensor 103F1 that remains stable against a top portion of the bunch.

The pressure reading taking by the pressure sensor 103F1 is provided through electronic circuitry to a controller for the media separator module 103. The controller resides in a control panel for the media separator or may be integrated into a control panel of the depository 100 (where other controllers execute for other peripherals associated with the depository 100). The controller represents executable instructions that are executed from memory (integrated into the control panel) by one or more processors (available on the control panel). In an embodiment, the executable instructions are firmware instructions executed from the control panel. The controller drives operation of the mechanical components of the media separator 103 through readings received from the sensors (103A, 103B, and 103F1).

Figure 1D:
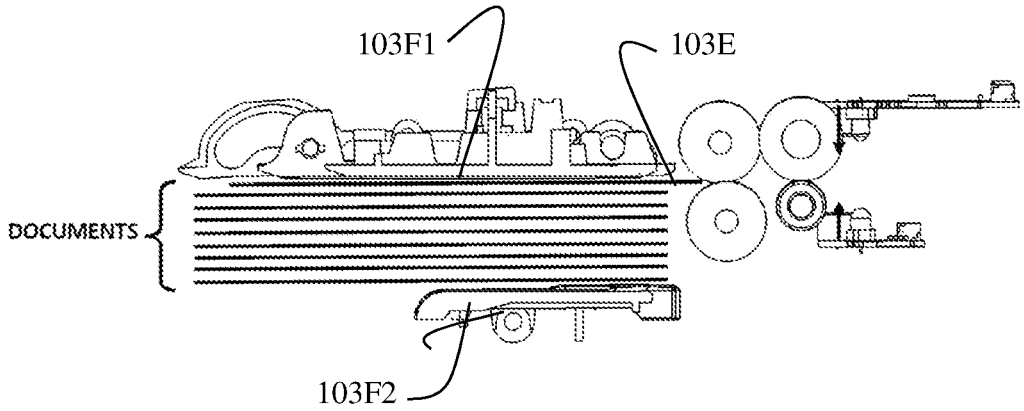
FIG. 1D is a diagram depicting an entry of a document from a bunch of documents into the media separator module having the tiltenator, according to an example embodiment.
Figure 1E:
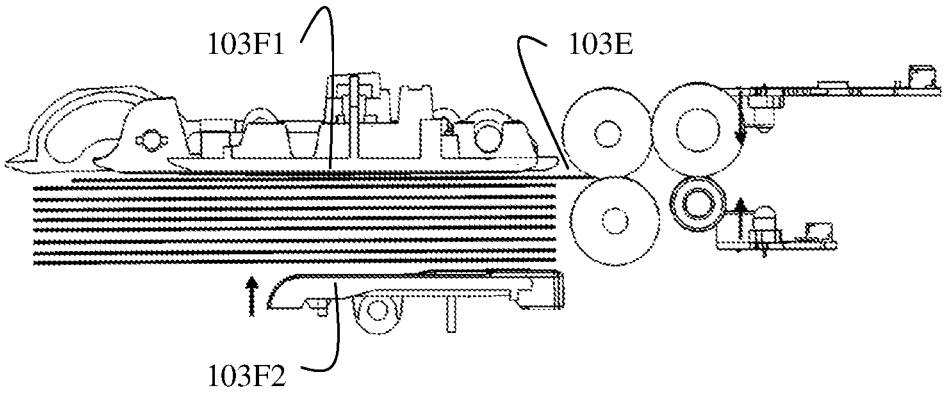
FIG. 1E is a diagram depicting a first adaptive increase in pressure by the tiltenator on the bunch of documents, according to an example embodiment.

FIG. 1E is a diagram depicting a first adaptive increase in pressure by the tiltenator 103F on the bunch of documents, according to an example embodiment.

Although the FIG. 1E appears to be similar to the FIG. 1D, the FIG. 1E is intended to illustrate that the pressure plate 103F1 has been moved by the controller upward against the bottom of the bunch to increase a pressure reading communicated by the pressure sensor 103F2. This increase in pressure reduces the size of the gap between 103F1 and 103F2 and increases the inter-document friction in the bunch.

FIG. 1E is also intended to illustrate a situation (condition) in which the document 103E (topmost document from the bunch) was not detected as being present at the sensors 103A and 103B within a predefined and short set period of elapsed time from when the bunch was initially inserted between 103F1 and 103F2 (as shown and discussed in the FIG. 1D). In response to this situation, the controller activates the pressure plate 103F2 to move upward against the bottom of the bunch establishing a greater pressure from the initial pressure that is reported by the pressure sensors 103F1 back to the controller.

Figure 1F:
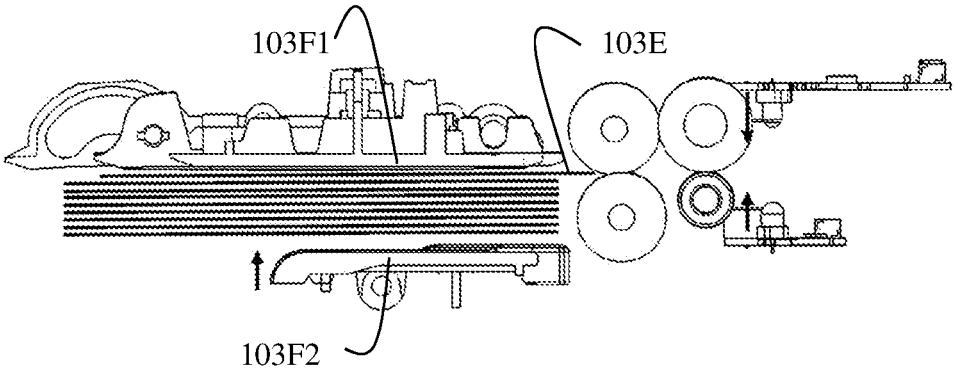
FIG. 1F is a diagram depicting a second adaptive increase in pressure by the tiltenator on the bunch of documents, according to an example embodiment.

FIG. 1F is a diagram depicting a second adaptive increase in pressure by the tiltenator 103F on the bunch of documents, according to an example embodiment.

The FIG. 1F illustrates a situation in which the adapted nature of the controller is deployed when after a first attempt in increase in pressure for the bunch held between the gap 103F3 (as shown in the FIG. 1E) still did not result in a document 103E being detected by the downstream sensors 103A and 103B within the short set period of elapsed time after the first pressure increase depicted in the FIG. 1E was attempted by the controller.

In fact, the increase in pressure attempts illustrated in the FIGS. 1E and 1F are iterated by the controller until a document is successfully fed through the media separator 103 (as noted by detection of that document as being present at the ultrasonic sensors 103A and 103B). That is, if the documents do not separate at the lowest and believed ideal pressure (shown in the FIG. 1D), the controller assumes that the documents (bunch of media) do not have a low enough inter-document friction or the controller assumes that the documents are not in a good enough physical condition for being separated and fed through the separator 100. When this condition is detected by the controller (based on non-detection of the sensors 103A and 103B of a document 103E (topmost document in the bunch) within the configurable short period of elapse time), the adaptive nature of the controller drives the pressure plate 103F2 to progressively achieve an increase in pressure for the bunch. This processing of the controller is iterated and repeated with successive increases in pressure until a document 103E successfully separates and is detected by the sensors 103A and 13B or until a predefined number of iterations for increasing the pressure fails entirely to separate the document 103E from the bunch.

Figure 1G:
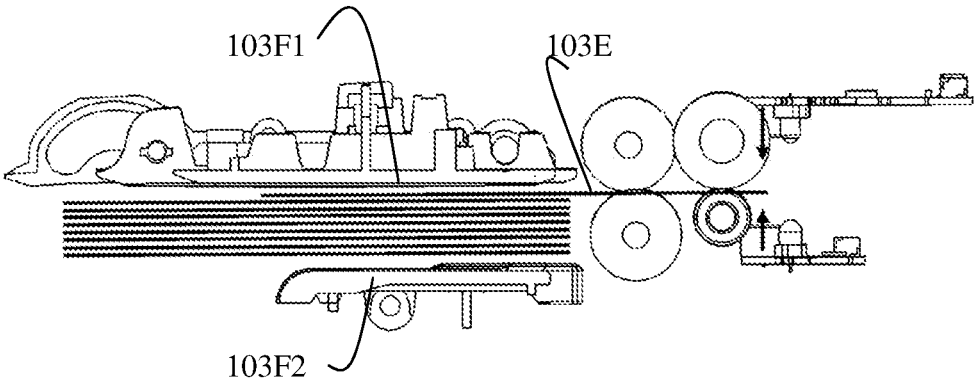
FIG. 1G is a diagram depicting a successful separation of a document from a bunch of documents achieved by the tiltenator, according to an example embodiment.

FIG. 1G is a diagram depicting a successful separation of a document from a bunch of documents achieved by the tiltenator 103F, according to an example embodiment.

The FIG. 1G illustrates a successful separation of a topmost document 103E from the bunch achieved by the tiltenator 103F through the adaptive increases in pressure on the bunch until the document 103E reaches the downstream sensors 103A and 103B within the short and configurable period of elapsed time (as discussed above with the FIGS. 1C-1F).

Figure 1H:
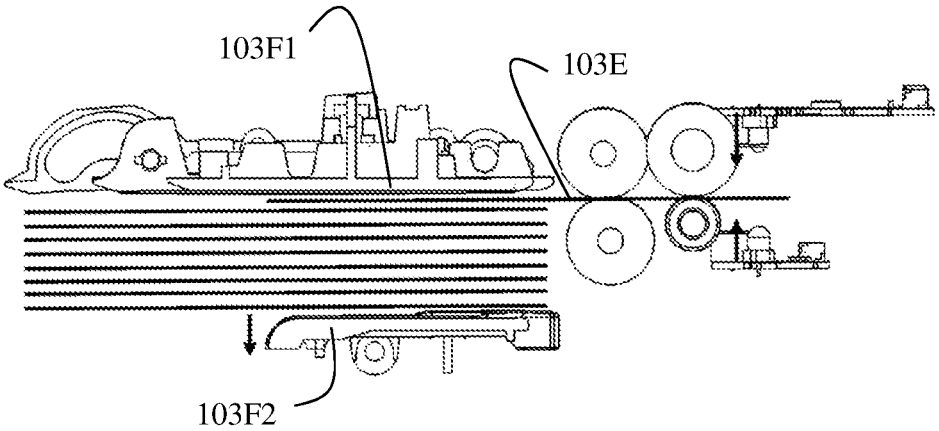
FIG. 1H is a diagram depicting an adaptive decrease in pressure by the tiltenator on the bunch of documents, according of an example embodiment.

So, when the document 103E does reach the sensors 103A and 103B within a short configurable of timeout period (as detected by the controller through readings of the sensors 103A and 103B), the controller adaptively decreases the pressure against the bunch as illustrated in the FIG. 1H.

This means that at least one of the documents 103E has been successfully separated from the bunch. Accordingly, in the FIG. 1H, the controller decreases the feeding pressure for remaining documents in the bunch (as illustrated by the increase in the size of the gap 103F3 between the pressure sensor 103F1 and the pressure plate 103F2 in the FIG. 1H). This adaptive decrease in pressure against the bunch also reduces the friction on a rear portion of the document 103E (the portion at least partially remaining in the bunch and between the pressure sensor 103F2 and the pressure plate 103F3). This improves the throughput of the document 103E through the media separator 103 by allowing the separator 103 to operate independently of the feeding pressure being adaptively controlled by the controller and by reducing the drag on the rear portion of the document that remains between the pressure sensor 103F1 and the pressure plate 103F2 as the remaining portion of the document 103E is being urged towards an exit point of the separator 103. Moreover, this adaptive pressure decrease on the bunch while a successfully separated document 103A remains in the separator 103 reduces a feed retry (based on a timeout reported from the separator 103) and further reduces the risk of critical/fatal faults by minimizing the back and forth handling of the individual and bunch of documents between the tiltenator 103F and the remaining components of the separator 103.

Figure 1I:
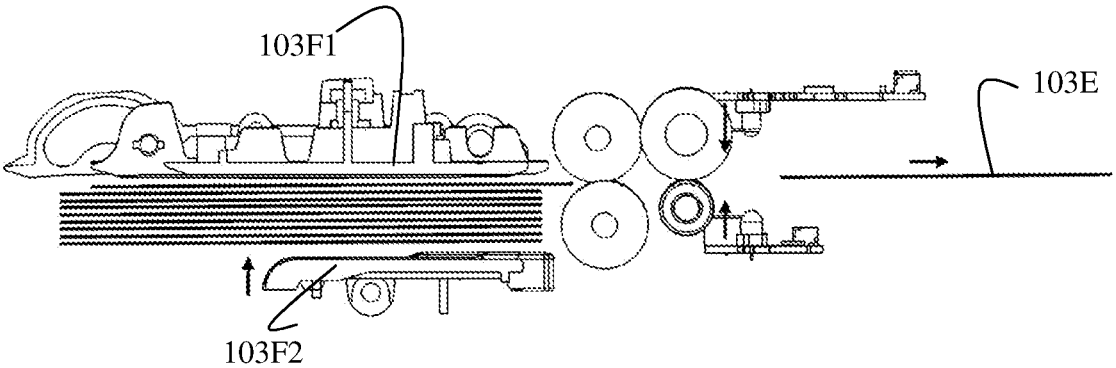
FIG. 1I is a diagram depicting an adaptive starting pressure by the tiltenator on the bunch of documents following a successful feed of a document through the media separator, according to an example embodiment.

FIG. 1I is a diagram depicting an adaptive starting pressure by the tiltenator 103F on the bunch of documents following a successful feed of a document through the media separator 103, according to an example embodiment.

The FIG. 1I illustrates a document 104E that has exited the separator 103 (as noted by the controller through readings reported by the sensors 103A and 103B). In response, the adaptive controller sets the pressure on the bunch (through controlling the pressure plate 103F2) to be what the pressure was when the document 104E was successfully separated (as shown and discussed in the FIGS. 1F and 1G).

That is, the controller adaptively presets the pressure on the remaining bunch within the tiltenator 103F to a last pressure value that successfully fed the document 104E through the separator 103 as soon as the document 103E is detected as having exited the separator 103 (using readings from the sensors 103A and 103B). This is based on a fair assumption that the next topmost document in the bunch that is to be separated from the bunch following a last successful feed is a document that is similar in type and condition to the last successfully fed document 103E. This assumption increases throughput of the documents through the separator 103 because the separator 103 does not have to wait for the pressure to be reset or recalibrated by the tiltenator 103F.

If a document does not reach the downstream sensors 103A and 103B and a predefined number of retry attempts are exhausted, only then does the controller back up that document and the bunch and reset the tiltenator 103F back to the initial pressure (discussed in the FIG. 1D above) with a new feeding cycle restarted. This is based on the assumption that the pressure against the bunch for the last successfully fed document 104E through the separator 103F is too high for the current and next document that is attempting to be separated from the bunch (because such current document resulted in an exhaustion of a predefined number of feed retires). After this pressure rest, the controller starts again with progressively and adaptively increasing the pressure as discussed above in the FIGS. 1D-1F.

The adaptive media feed processing (discussed above and below) feeds documents (media) from a bunch with less retries than conventional techniques resulting in: 1) faster media feeding and processing through a separator and depository; 2) less inconvenient faults, and 3) less critical/fatal faults (which occur when feeding retries are exhausted). The adaptive feed processing handles individual documents in a bunch and the bunch as a whole in a least aggressive manner possible that leads to more successful media feeding.

These and other embodiments are now discussed with reference to the FIGS. 2-4.

Figure 2:
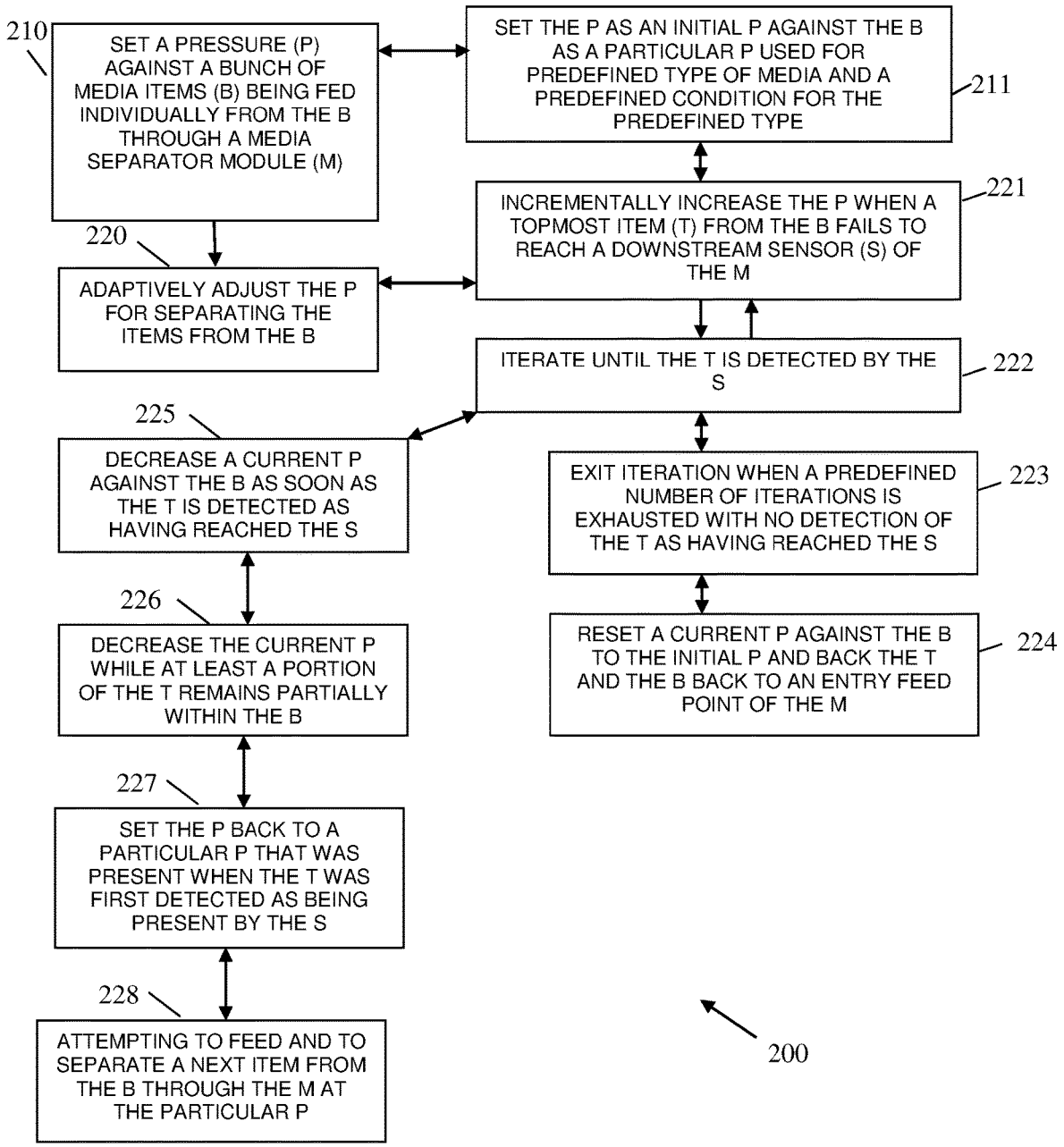
FIG. 2 is a diagram of a method for adaptive pressure media feeding and processing within a tiltenator of a media separator module, according to an example embodiment.

FIG. 2 is a diagram of a method for adaptive pressure media feeding and processing within a tiltenator of a media separator, according to an example embodiment. The method 200 when processed controls operation for a tiltenator of a media separator module integrated into a valuable media depository. The method 200 is implemented as executable instructions representing one or more software modules referred to as an "adaptive-pressure media-feed controller." The instructions reside in a non-transitory computer-readable medium and are executed by one or more processors of the valuable media depository.

In an embodiment, the adaptive-pressure media-feed controller is executed by one or more processors of the valuable media depository 100.

In an embodiment, the adaptive-pressure media-feed controller is the controller discussed above with the FIGS. 1B-1I.

In an embodiment, the tiltenator is the tiltenator 103F.

In an embodiment, the media depository is a deposit module.

In an embodiment, the media depository is a recycler module.

In an embodiment, the media depository is a peripheral device integrated into an SST. In an embodiment, the SST is an ATM. In an embodiment, the SST is a kiosk.

In an embodiment, the media depository is a peripheral device integrated into a Point-Of-Sale (POS) terminal.

In an embodiment, the adaptive-pressure media-feed controller is a controller implemented within firmware of a media depository and executed by one or more processors and memory associated with the controller to perform the processing discussed above with the FIGS. 1B-1I.

At 210, the adaptive-pressure media-feed controller sets a pressure against a bunch of media items being fed individually and separated from the bunch through a media separator module.

In an embodiment, the adaptive-pressure media-feed controller sets the pressure by urging a pressure plate 103F2 upward against a bottommost item of the bunch, thereby pushing a topmost item of the bunch against a pressure sensor 103F1 and compressing the bunch.

According to an embodiment, at 211, the adaptive-pressure media-feed controller sets the pressure as an initial pressure against the bunch as a particular pressure for a predefined type of media and a predefined condition for the predefined type. That is, an ideal pressure for a type of media and a condition for that media is used for setting the pressure as the initial pressure.

At 220, the adaptive-pressure media-feed controller adaptively adjusts the pressure for separating the items from the bunch. This is done by dynamically increasing and/or decreasing the pressure against the bunch to optimally separate the items from the bunch for individual processing within the media separator module.

In an embodiment of 211 and at 221, the adaptive-pressure media-feed controller incrementally increases the pressure when a topmost item (the item being initially separated) from the bunch fails to reach a downstream sensor of the media separator module. In an embodiment, the sensor is the sensor(s) 103A and/or 103B.

In an embodiment of 221 and at 222, the adaptive-pressure media-feed controller iterates the processing at 221 until the topmost item is detected as being present at the downstream sensor.

In an embodiment of 222 and at 223, the adaptive-pressure media-feed controller exits and stops iterating the processing at 221 when a predefined number of iterations (refeed tries) is exhausted with still no detection of the topmost item as having reached the downstream sensor.

In an embodiment of 223 and at 224, the adaptive-pressure media-feed controller resetting a then-current pressure against the bunch to the initial pressure (set at 211) and backs the topmost item and bunch back to an entry point of the media separator.

In an embodiment of 222 and at 225, the adaptive-pressure media-feed controller decreases a current pressure against the bunch as soon as the topmost item is detected as having reached the downstream sensor.

In an embodiment of 225 and at 226, the adaptive-pressure media-feed controller decreases the current pressure while at least a portion of the topmost item remains partially within the bunch and present at the downstream sensor (as shown in the FIG. 1H).

In an embodiment of 226 and at 227, the adaptive-pressure media-feed controller set the pressure back to a particular pressure that was present when the topmost item was first detected as being present at the downstream sensor (the particular pressure being the pressure when the topmost item was first detected as being present by the sensor).

In an embodiment of 227 and at 228, the adaptive-pressure media-feed controller attempts to feed and to separate a next item from the bunch through the media separator at the particular pressure set at 227.

The adaptive-pressure media-feed controller continues to iterate in the manners discussed above until each item of media is separated from the bunch and processed through the media separator.

Figure 3:
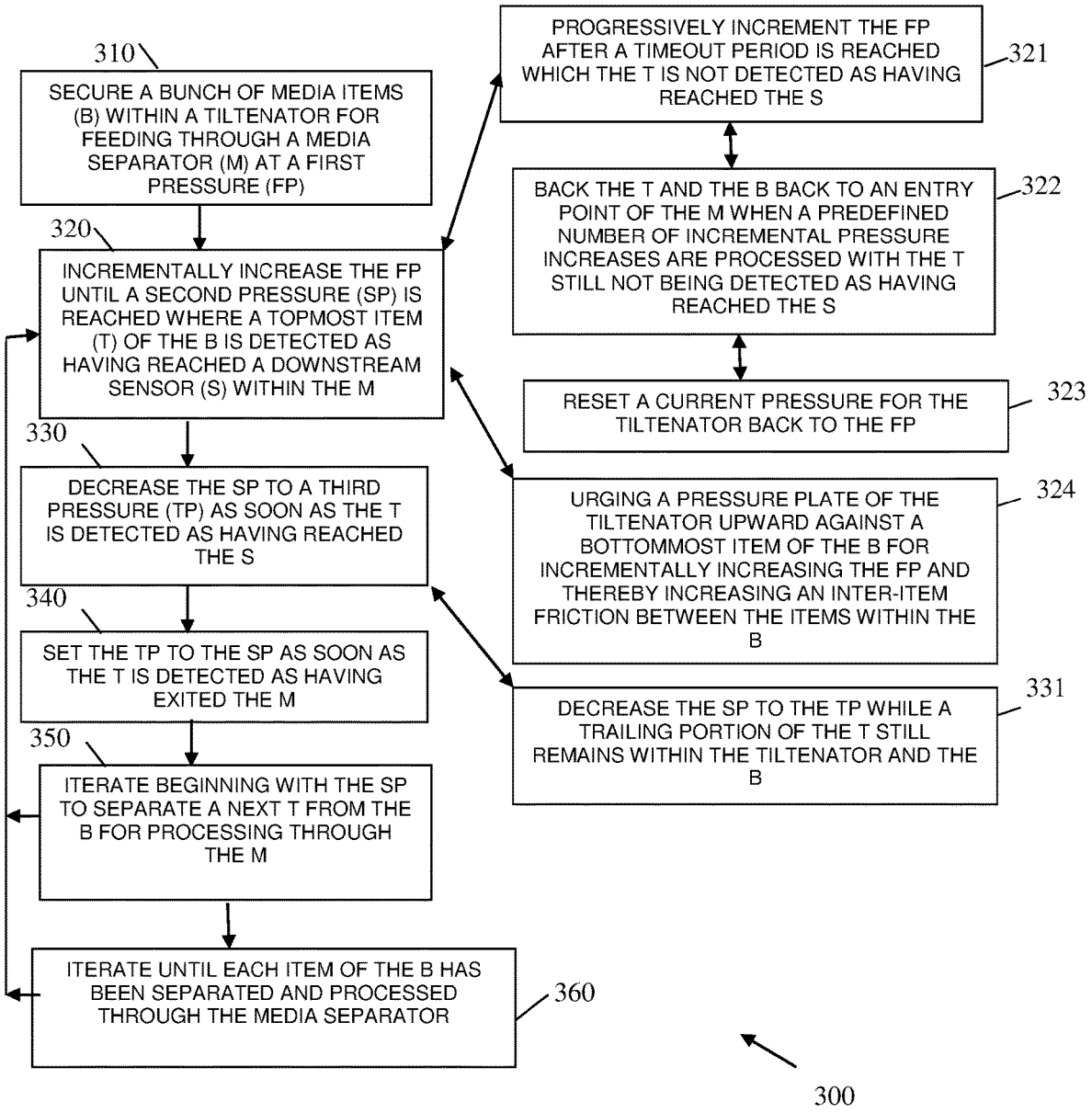
FIG. 3 is a diagram of another method for adaptive pressure media feeding and processing within a tiltenator of a media separator module, according to an example embodiment.

FIG. 3 is a diagram of another method 300 for adaptive pressure media feeding and processing within a tiltenator of a media separator module, according to an example embodiment. The method 300 when processed controls media feed processing within a valuable media depository by controlling operation of a tiltenator for a media separator integrated within a depository. The method 200 is implemented as executed instructions representing one or more software modules referred to as a media-feed-pressure manager. The instructions reside in a non-transitory computer-readable medium and are executed by one or more processors of the valuable media depository.

In an embodiment, the media-feed-pressure manager is executed by one or more processors of the valuable media depository 100.

In an embodiment, the media depository is a deposit module.

In an embodiment, the media depository is a recycler module.

In an embodiment, the media depository is a peripheral device integrated into an SST. In an embodiment, the SST is an ATM. In an embodiment, the SST is a kiosk.

In an embodiment, the media depository is a peripheral device integrated into a Point-Of-Sale (POS) terminal.

In an embodiment, the tiltenator is the tiltenator 103F.

In an embodiment, the media-feed-pressure manager implements the processing discussed above with the FIGS. 1A-1I and 2.

In an embodiment, the media-feed-pressure manager presents another and in some ways enhance perspective of the processing depicted in the method 200 (presented above with the discussion of the FIG. 2 and the adaptive-pressure media-feed controller).

At 310, the media-feed-pressure manager secures a bunch of media items within a tiltenator for feeding through a media separator at a first pressure.

At 320, the media-feed-pressure manager incrementally, adaptively, and progressively increases the first pressure until a second pressure is reached where a topmost item of the bunch is detected has having reached a downstream sensor within the media separator.

In an embodiment, the sensor is the sensor 103A and/or 103B.

According to an embodiment, at 321, the media-feed-pressure manager progressively and adaptively increments the first pressure after a timeout period (discussed above with the FIGS. 1A-1I) is reached in which the topmost item is not detected as having reached the sensor.

In an embodiment of 321 and at 322, the media-feed-pressure manager backs the topmost item and the bunch back to an entry point of the media separator when a predefined number of incremental pressure increases are processed with the topmost item still not being detected as having reached the downstream sensor.

In an embodiment of 322 and at 323, the media-feed-pressure manager resets a current pressure for the tiltenator back to the first pressure.

In an embodiment, at 324, the media-feed-pressure manager urges a pressure plate of the tiltenator upward against a bottommost item of the b for incrementally increasing the first pressure and thereby increasing an inter-item friction between the items within the bunch.

At 330, the media-feed-pressure manager decrease the second pressure to a third pressure as soon as the topmost item is detected as having reached the downstream sensor.

According to an embodiment, at 331, the media-feed-pressure manager decreases the second pressure to the third pressure while a trailing portion of the topmost item still remains within the tiltenator and the bunch.

At 340, the media-feed-pressure manager sets the third pressure to the second pressure as soon as the topmost item is detected as having exited the media separator (as reported by readings from the downstream sensor). The second pressure that is the pressure that was found when the topmost item was detected as being present at the downstream sensor at 320.

At 350, the media-feed-pressure manager iterates back to 320 to separate a next topmost item from the bunch for processing through the media separator.

In an embodiment, at 360, the media-feed-pressure manager iterates back to 320 until each item of the bunch has been separated from the bunch and processed through the media separator.

Figure 4:
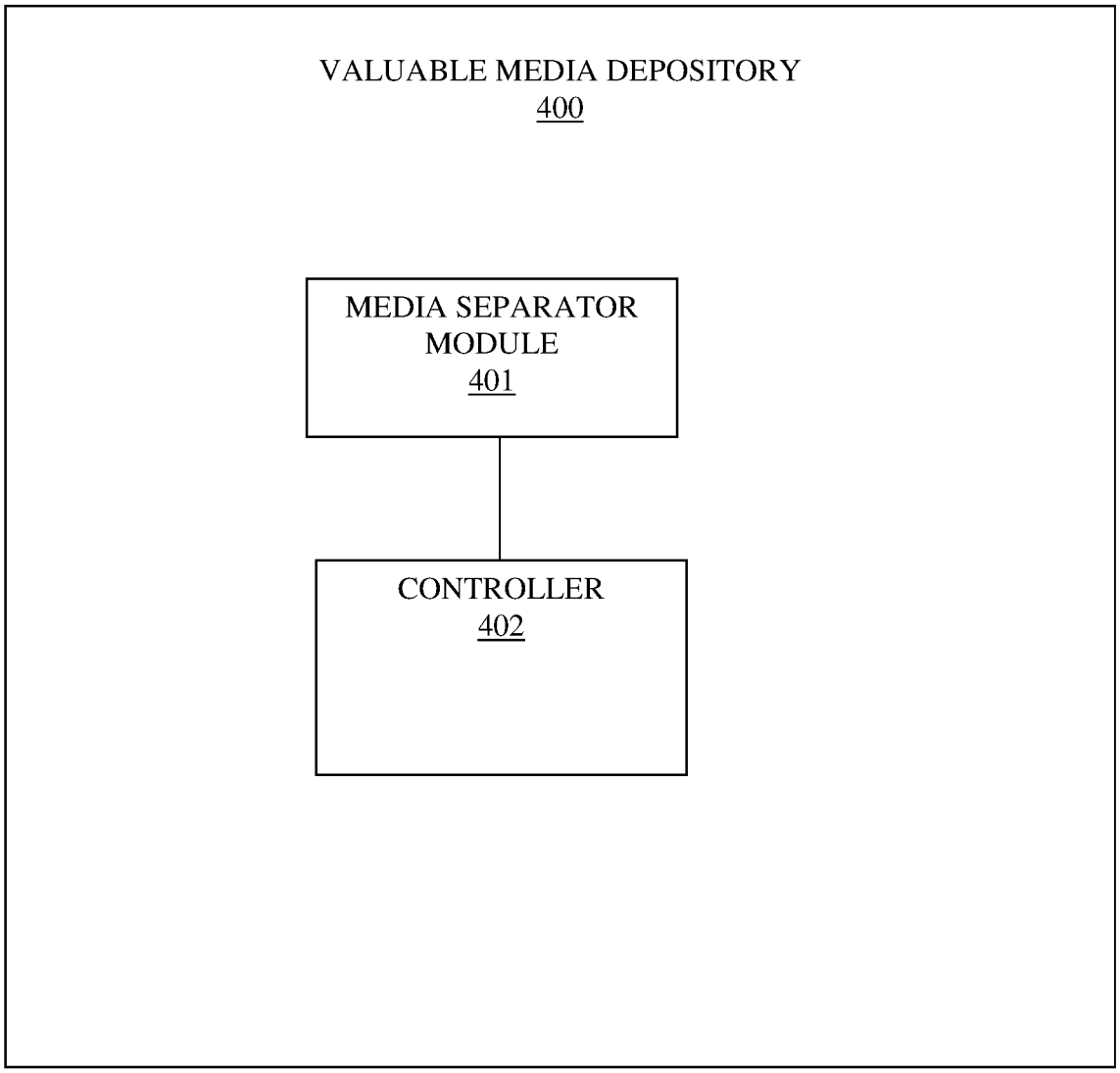
FIG. 4 is a diagram of a valuable media depository, according to an example embodiment.

FIG. 4 is a media depository 400 with a media separator module, according to an example embodiment. The valuable media depository 400 processes valuable media and includes a variety of mechanical, electrical, and software/firmware components, some of which were discussed above with reference to the FIGS. 1A-1I and the FIGS. 2-3.

In an embodiment, the valuable media depository 400 is a deposit module.

In an embodiment, the valuable media depository 400 is a recycler module.

In an embodiment, the valuable media depository 400 is the depository 100.

In an embodiment, the valuable media depository 400 is the depository that performs: any or, some combination of, or all of the processing discussed above in the FIGS. 1A-1I and 2-3.

In an embodiment, the valuable media depository 400 is a peripheral device integrated into an SST. In an embodiment, the SST is an ATM. In an embodiment, the SST is a kiosk.

In an embodiment, the valuable media depository 400 is a peripheral device integrated into a Point-Of-Sale (POS) terminal.

The valuable media depository 400 includes a media separator module 401 including a controller 402 operable to control a tiltenator of the media separator module 401.

In an embodiment, the tiltenator is the tiltenator 103F.

The controller 402 is configured to adaptively, progressively, and/or incrementally increase and/or decrease a pressure against a bunch of media items within the tiltenator for separating each item from the bunch for individual processing through the media separator module 401.

In an embodiment, the controller 402 is further configured to dynamically decrease the pressure against the bunch within the tiltenator when a separated item from the bunch is detected as having reached a downstream sensor within the media separator and while a trailing portion of the separated item remains within the tiltenator and the bunch.

In an embodiment the sensor is the sensors 103A and/or 103B.

In an embodiment, the controller 402 drives the electromechanical components of the tiltenator 103F for the media separator module 103 as discussed in the FIGS. 1B-1I and the FIGS. 2-3.

In an embodiment, the controller 402 is the controller discussed above with reference to the FIGS. 1B-1I and/or 2-3.

In an embodiment, the controller 402 is the method 200 of the FIG. 2.

In an embodiment, the controller 402 is the method 300 of the FIG. 3.

In an embodiment, the controller 402 performs all or some combination of the processing performed by: the processing discussed above with reference to the FIGS. 1A-1I, the method 200, and the method 300.

The above description is illustrative, and not restrictive. Many other embodiments will be apparent to those of skill in the art upon reviewing the above description. The scope of embodiments should therefore be determined with reference to the appended claims, along with the full scope of equivalents to which such claims are entitled.

In the foregoing description of the embodiments, various features are grouped together in a single embodiment for the purpose of streamlining the disclosure. This method of disclosure is not to be interpreted as reflecting that the claimed embodiments have more features than are expressly recited in each claim. Rather, as the following claims reflect, inventive subject matter lies in less than all features of a single disclosed embodiment. Thus the following claims are hereby incorporated into the Description of the Embodiments, with each claim standing on its own as a separate exemplary embodiment.

The invention claimed is:

1. A depository comprising:

a media separator module comprises a tiltenator;

the tiltenator comprises a top portion and a bottom portion, wherein the top portion comprises a pressure sensor and belts, and wherein the bottom portion comprises a pressure plate; and a controller operable to control a tiltenator based on pressure readings taking by the pressure sensor of the media separator module;

wherein the controller is configured to progressively increase and decrease a pressure against a bunch of media items for separating each item from the bunch for individual processing through the media separator module by controlling movement of the pressure plate upwards against the bunch and downwards away from the bunch based on the pressure readings of the pressure sensor, and wherein the controller is further configured to progressively increase the pressure against the bunch until a separated item from the bunch is detected as having reached a downstream sensor, wherein the controller is further configured to incrementally increase the pressure until separated item is detected by the downstream sensor, wherein the controller is configured to decrease a current pressure against the bunch as soon as the separated item is detected having reached the downstream sensor;

wherein the controller is further configured to incrementally increase the pressure by a plurality of discrete pressure steps until the separated item is detected by the downstream sensor;

wherein the controller is further configured to decrease the current pressure against the bunch while a trailing portion of the separated item remains pinched within the tiltenator;

wherein the controller is further configured to set the pressure back to a particular pressure that successfully fed a previous separated item as soon as the separated item is detective has having exited the media separator.

2. The depository of claim 1, wherein the controller is further configured to progressively decrease the pressure against the bunch when the separated item from the bunch is detected as having reached the downstream sensor within the media separator module and while the trailing portion of the separated item remains within the tiltenator and the bunch.

3. The depository of claim 1, wherein the depository is one of: a deposit module and a recycler module.

* * * * *